US011690401B2

(12) United States Patent
Liu et al.

(10) Patent No.: US 11,690,401 B2
(45) Date of Patent: Jul. 4, 2023

(54) ULTRASONIC ELECTRONIC CIGARETTE ATOMIZER

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Lizhou Shen, Hunan (CN); Yongquan Zhou, Hunan (CN); Yang Wang, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 489 days.

(21) Appl. No.: 16/647,003

(22) PCT Filed: Sep. 13, 2018

(86) PCT No.: PCT/CN2018/105505
§ 371 (c)(1),
(2) Date: Mar. 12, 2020

(87) PCT Pub. No.: WO2019/052506
PCT Pub. Date: Mar. 21, 2019

(65) Prior Publication Data

US 2020/0214349 A1 Jul. 9, 2020

(30) Foreign Application Priority Data

Sep. 13, 2017 (CN) ..... 201721169075.8
Sep. 13, 2017 (CN) ..... 201721169084.7

(51) Int. Cl.
*A24F 40/05* (2020.01)
*A24F 40/10* (2020.01)
(Continued)

(52) U.S. Cl.
CPC ..... *A24F 40/05* (2020.01); *A24B 15/167* (2016.11); *A24F 40/44* (2020.01); *A24F 40/46* (2020.01);
(Continued)

(58) Field of Classification Search
CPC ..... A24F 40/05; A24F 40/10; A24F 40/44; A24F 40/46; A24F 40/48; A24F 40/485
See application file for complete search history.

(56) References Cited

U.S. PATENT DOCUMENTS

2015/0144147 A1* 5/2015 Li et al. ..... F22B 1/284
2016/0089508 A1 3/2016 Smith et al.
2017/0189629 A1* 6/2017 Newberry ..... A61M 11/041

FOREIGN PATENT DOCUMENTS

CN 204653788 U 9/2015
CN 205432145 U 8/2016
(Continued)

OTHER PUBLICATIONS

International Search Report issued in International Application No. PCT/CN2018/105505 dated Dec. 17, 2018, 3 pages.

*Primary Examiner* — Michael J Felton
*Assistant Examiner* — Ronnie Kirby Jordan
(74) *Attorney, Agent, or Firm* — Mauriel Kapouytian Woods LLP; Ran Pang; Michael Mauriel

(57) ABSTRACT

An ultrasonic electronic cigarette atomizer are disclosed. The atomizer includes an ultrasonic atomization sheet (1), an atomization cotton (3), a liquid chamber (2), an air inlet tube (6), an air outlet channel (7), and a suction nozzle (8). The atomization cotton (3) is communicated with the liquid
(Continued)

chamber (2) and is in contact with an atomization surface of the ultrasonic atomization sheet (1). An inlet of the air inlet tube (6) is communicated with the outside. The air inlet tube (6), an atomization region of the ultrasonic atomization sheet (1), the air outlet channel (7), and the suction nozzle (8) are communicated in sequence. An outlet of the air inlet tube (6) is opposite to the atomization region of the ultrasonic atomization sheet (1).

14 Claims, 9 Drawing Sheets

(51) Int. Cl.

| | |
|---|---|
| ***A24F 40/40*** | (2020.01) |
| ***A24B 15/167*** | (2020.01) |
| ***A24F 40/48*** | (2020.01) |
| ***H05B 3/00*** | (2006.01) |
| ***A24F 40/46*** | (2020.01) |
| ***A24F 40/44*** | (2020.01) |
| ***A24F 40/485*** | (2020.01) |

(52) U.S. Cl.
CPC ..... *A24F 40/48* (2020.01); *A24F 40/485* (2020.01); *H05B 3/0014* (2013.01); *A24F 40/10* (2020.01)

(56) References Cited

FOREIGN PATENT DOCUMENTS

| | | | |
|---|---|---|---|
| CN | 205912905 | U | 2/2017 |
| CN | 205947128 | U | 2/2017 |
| CN | 206025226 | U | 3/2017 |
| CN | 106579555 | A | 4/2017 |
| CN | 207185926 | U | 4/2018 |
| CN | 207400330 | U | 5/2018 |

* cited by examiner

ULTRASONIC ELECTRONIC CIGARETTE ATOMIZER

CROSS REFERENCE TO RELATED APPLICATIONS

This application is a U.S. National Phase application under 35 U.S.C. § 371 of International Application No. PCT/CN2018/105505 filed on Sep. 13, 2018, which claims priority to Chinese Application Number 201721169075.8 filed on Sep. 13, 2017 and Chinese Application Number 201721169084.7 filed on Sep. 13, 2017. The entire contents of these applications are hereby incorporated herein by reference.

FIELD OF THE INVENTION

The present invention belongs to the technical field of electronic cigarettes, and particularly relates to an ultrasonic electronic cigarette atomizer.

BACKGROUND OF THE INVENTION

The existing ultrasonic electronic cigarette atomizer comprises an ultrasonic atomization sheet, an atomization cotton, a liquid chamber, an air inlet tube, an air outlet channel, and a suction nozzle, wherein the atomization cotton is communicated with the liquid chamber and is in contact with an atomization surface of the ultrasonic atomization sheet, an inlet of the air outlet channel is opposite to an atomization region of the ultrasonic atomization sheet, and an outlet of the air outlet channel is communicated with the suction nozzle. The air inlet tube, the atomization region of the ultrasonic atomization sheet, the air outlet channel, and the suction nozzle are communicated in sequence.

The existing ultrasonic electronic cigarette atomizer has the following disadvantages: First, because the atomization region of the ultrasonic atomization sheet is opposite to the inlet of the air outlet channel, large granular liquid beads generated by atomization of the ultrasonic atomization sheet are easily sprayed into a user's mouth along the side wall of the air outlet channel or the air flow, causing the suction of liquid by a user and a poor user experience.

Second, the air inlet tube is a cylindrical straight tube having the same inner diameter, the rate of air when flowing through the air inlet tube is uniform, and the air will not have a too large impact on the atomization cotton when flowing out of an air outlet end of the air inlet tube, so the liquid accumulated in the center of the atomization cotton will not be scattered to the edge by the impact. Therefore, the ultrasonic atomization sheet is easily immersed in the liquid at the beginning of operation, the starting speed is low, the amount of smoke is unstable at the beginning of smoking, and even no smoke occurs at the beginning of smoking.

Third, in order to achieve close contact between the atomization cotton and the ultrasonic atomization sheet, a cotton compression spring is usually provided to compress the atomization cotton onto the ultrasonic atomization sheet. In the prior art, one end of the cotton compression spring abuts against the atomization cotton, the other end of the cotton compression spring abuts against a boss on the air outlet tube, and the cotton compression spring is opposite to the inlet of the air outlet tube. When liquid beads are accumulated on the cotton compression spring, the liquid beads are easily brought into the user's mouth by the air flow via the air outlet tube, so that the liquid is sucked, the mouth is easily scalded, the smoke taste is poor, and the user experience is affected.

Fourth, when the ultrasonic atomization sheet oscillates at a high frequency, the atomization cotton is prone to be broken or perforated by oscillation, so that the service life of the atomization cotton is short, the liquid guiding and atomization effects are affected, and the user experience is poor.

SUMMARY OF THE INVENTION

The present invention is directed to provide an improved ultrasonic electronic cigarette atomizer for the disadvantages of the prior art, where the ultrasonic atomization sheet is unlikely to be immersed in tobacco tar, high in starting speed and stable in smoke amount, it is not easy for a user to suck the tobacco tar, and the smoke taste is good; the atomization cotton can be prevented from being broken by oscillation, the service life of the atomization cotton is prolonged, and the liquid guide and atomization effects and the user experience are good.

In order to solve the above technical problems, the technical solution adopted by the present invention is as follows:

An ultrasonic electronic cigarette atomizer, comprising an ultrasonic atomization sheet, an atomization cotton, a liquid chamber, an air inlet tube, an air outlet channel, and a suction nozzle, wherein the atomization cotton is communicated with the liquid chamber and is in contact with an atomization surface of the ultrasonic atomization sheet, an inlet of the air inlet tube is communicated with the outside, and the air inlet tube, an atomization region of the ultrasonic atomization sheet, the air outlet channel, and the suction nozzle are communicated in sequence; the structure characteristic of the ultrasonic electronic cigarette atomizer is that an outlet of the air inlet tube is opposite to the atomization region of the ultrasonic atomization sheet.

Because the outlet of the air inlet tube is opposite to the atomization region of the ultrasonic atomization sheet, the direction of inlet air flow in the air inlet tube is opposite to the direction of spraying smoke generated by the ultrasonic atomization sheet, large granular liquid beads in the smoke are brought back to the atomization region of the ultrasonic atomization sheet for atomization again with the air flow, and the smoke containing small granules flows with the air flow for a user to smoke, thereby preventing the user from sucking the large granular liquid beads and scald the mouth, and improving the smoke taste and the utilization and cost of the tobacco tar.

As a preferred mode, the inner diameter of an air inlet end of the air inlet tube is greater than that of an air outlet end of the air inlet tube.

With the above structure, because the inner diameter of the air inlet end of the air inlet tube is greater than that of the air outlet end of the air inlet tube, when air flows through the air inlet tube, the air flow velocity is higher because of the small inner diameter of the air outlet end. The air flowing fast has a large impact on the ultrasonic atomization sheet, which can blow the accumulated liquid in the center of the atomization cotton to the edge, thereby avoiding the phenomenon of immersion of the ultrasonic atomization sheet in the tobacco tar, improving the speed of atomizing the liquid by the ultrasonic atomization sheet, achieving a high smoke emission speed and a stable smoke volume, and avoiding the situation that there is no smoke or a small amount of smoke at the beginning of smoking due to the immersion in the tobacco tar. Further, the air inlet tube is a tapered tube.

Further, the ultrasonic electronic cigarette atomizer comprises an upper cover, wherein the top end of the upper cover is connected to the suction nozzle, the bottom end of the upper cover is connected to a lower cover, and a bottom cover is connected to the bottom of the lower cover; the ultrasonic atomization sheet is fixed through an atomization seat in the bottom cover; the liquid chamber, an inner sleeve and an outer sleeve are disposed in the upper cover; the side wall of the atomization cotton is sleeved between the inner sleeve and the outer sleeve, and the air inlet tube is connected to the suction nozzle through an adapter.

Further, the ultrasonic electronic cigarette atomizer comprises a first air guide tube and a second air guide tube, wherein a cavity is formed between the inner wall of the inner sleeve and the lower section of the air inlet tube, the upper section of the first air guide tube is connected to the adapter, the upper section of the second air guide tube is connected to a connecting sleeve, the lower section of the first air guide tube and the lower section of the second air guide tube both extend into the cavity, and the lower section of the first air guide tube and the lower section of the second air guide tube are not in contact with the inner wall of the cavity; an air passage is formed between the outer wall of the first air guide tube and the inner wall of the second air guide tube, and the cavity and the air passage form the air outlet channel.

With the above structure, the lower section of the first air guide tube and the lower section of the second air guide tube are both suspended and extend into the cavity, and the lower section of the first air guide tube and the lower section of the second air guide tube are not in contact with the inner wall of the cavity, so the large granular liquid beads condensed on the wall of the cavity can be blocked from entering the user's mouth along with the outer walls of the lower section of the first air guide tube and the lower section of the second air guide tube. Because the cross-sectional area of the air passage is smaller than that of the cavity, the smoke passing through the air passage is squeezed during smoking, and part of the large granular liquid beads in the smoke are squeezed and hit the wall of the cavity to form condensed liquid beads, which can also prevent the large granular liquid beads from being sucked into the user's mouth, and achieve a good user experience.

As a preferred mode, the atomization cotton is cup-shaped, the side wall of the atomization cotton is sleeved between the inner sleeve and the outer sleeve, and the outer bottom surface of the atomization cotton is in contact with the atomization surface of the ultrasonic atomization sheet.

Further, the ultrasonic electronic cigarette atomizer comprises a cotton compression spring, wherein one end of the cotton compression spring abuts against the inner bottom surface of the atomization cotton, and the other end of the cotton compression spring abuts against the inner sleeve.

The cotton compression spring enables the atomization cotton to be in close contact with the ultrasonic atomization sheet, thereby improving the atomization effect.

Further, the ultrasonic electronic cigarette atomizer comprises a liquid guide cotton, wherein the liquid guide cotton is sleeved between the inner sleeve and the atomization cotton.

The inner wall of the atomization cotton is in contact with the liquid guide cotton. When the liquid in the liquid chamber is sufficient, a certain amount of liquid is stored in the liquid guide cotton. The liquid stored in the liquid guide cotton is guided to the ultrasonic atomization sheet by the atomization cotton, heated and atomized, so that when it is inconvenient to add tobacco tar, the user can also smoke for a short time, the dry burning of the ultrasonic atomization sheet is prevented, and the convenience of use is improved.

Further, a thread cap for sealing is disposed at the bottom of the bottom cover, a lower electrode is disposed in the thread cap, and the thread cap is insulated from and connected with the lower electrode by an insulating ring.

Further, a gasket is disposed between the suction nozzle and the upper cover, and a seal ring is disposed between the lower cover and the upper cover.

Further, the bottom of the outer wall of the air inlet tube is provided with a blocking portion for blocking large granular smoke.

When the ultrasonic atomization sheet oscillates at a high frequency to atomize the liquid to produce smoke, the blocking portion blocks the smoke sprayed vertical to the ultrasonic atomization sheet. At this time, the large granular liquid beads in the smoke are blocked by the blocking portion and condensed on the blocking portion, and other small granular liquid beads, i.e., the smoke, turn off with the air flow to enter the user's mouth, thereby preventing the large granular liquid beads from entering the user's mouth, and improving the user's mouthfeel of smoking.

Further, the ultrasonic electronic cigarette atomizer comprises a cotton compression spring, wherein one end of the cotton compression spring abuts against the atomization cotton and causes the atomization cotton to be in close contact with the ultrasonic atomization sheet, and the other end of the cotton compression spring abuts against a boss at the end of the air inlet tube.

The cotton compression spring is disposed at an end of the air inlet tube. On the one hand, the cotton compression spring can be used to compress the atomization cotton, so that the atomization cotton is in close contact with the ultrasonic atomization sheet, and the liquid is continuously guided to prevent the ultrasonic atomization sheet from drying out. On the other hand, since the cotton compression spring is disposed at the outlet end of the air inlet tube, the large granular liquid beads condensed on the cotton compression spring which sprayed by the ultrasonic atomization sheet when it operates will fall onto the ultrasonic atomization sheet with the air flow and be heated and atomized again, the large granular liquid beads are prevented from entering the user's mouth to scald the user's mouth, the smoke tastes delicate, the user experience is good, and the utilization of liquid is high.

Further, the ultrasonic electronic cigarette atomizer comprises a mat layer for preventing the atomization cotton from being broken by oscillation.

The mat layer can reinforce or isolate the atomization cotton, thereby preventing the atomization cotton from being broken by the high-frequency oscillation of the ultrasonic atomization sheet, prolonging the service life of the atomization cotton, achieving good liquid guiding and atomization effects, preventing the user from sucking the floc of the broken atomization cotton to affect the physical health, and having good user experience.

As a preferred mode, two layers of cotton sheets are disposed on the atomization cotton at a position corresponding to the ultrasonic atomization sheet, and the mat layer is sandwiched between the two layers of cotton sheets;

Alternatively, a single layer of cotton sheet is disposed on the atomization cotton at a position corresponding to the ultrasonic atomization sheet, and the mat layer is embedded into the single layer of cotton sheet.

If the mat layer is sandwiched between the two layers of cotton sheets, the two layers of cotton sheets play a reinforcing role to prevent the atomization cotton from being broken when the ultrasonic atomization sheet oscillates at a high frequency to impact the atomization cotton.

If the mat layer is embedded into the single layer of cotton sheet, the effect of fixing the atomization cotton is achieved.

As another preferred mode, the mat layer is sandwiched between the atomization cotton and the ultrasonic atomization sheet.

When the mat layer is sandwiched between the atomization cotton and the ultrasonic atomization sheet, the atomization cotton is in indirect contact with the ultrasonic atomization sheet, that is, there is a small gap between the atomization cotton and the ultrasonic atomization sheet. The impact force generated when the ultrasonic atomization sheet oscillates at a high frequency hits the mat layer first, and then is transferred to the atomization cotton through the mat layer. At this time, the impact force received by the atomization cotton is reduced, so that the atomization cotton is unlikely to break, and the service life of the atomization cotton is prolonged.

As a preferred mode, the thickness of the cotton sheet is 0.1 to 0.8 mm.

The thickness of the cotton sheet is 0.1 to 0.8 mm, preferably 0.1 to 0.4 mm, which can increase the liquid guide amount and the smoke emission amount, and improves the user experience.

As a preferred mode, the thickness of the mat layer is 0.05 to 0.3 mm.

Compared with the prior art, the ultrasonic atomization sheet in the present invention is unlikely to be immersed in tobacco tar, high in starting speed and stable in smoke amount, it is difficult for a user to suck the tobacco tar, and the smoke taste is good. The atomization cotton can be prevented from being broken by oscillation, the service life of the atomization cotton is prolonged, the liquid guiding and atomization effects are good, the smoke taste is improved, and the user experience is good.

DETAILED DESCRIPTION OF EMBODIMENTS

Embodiment 1

Figure 1:
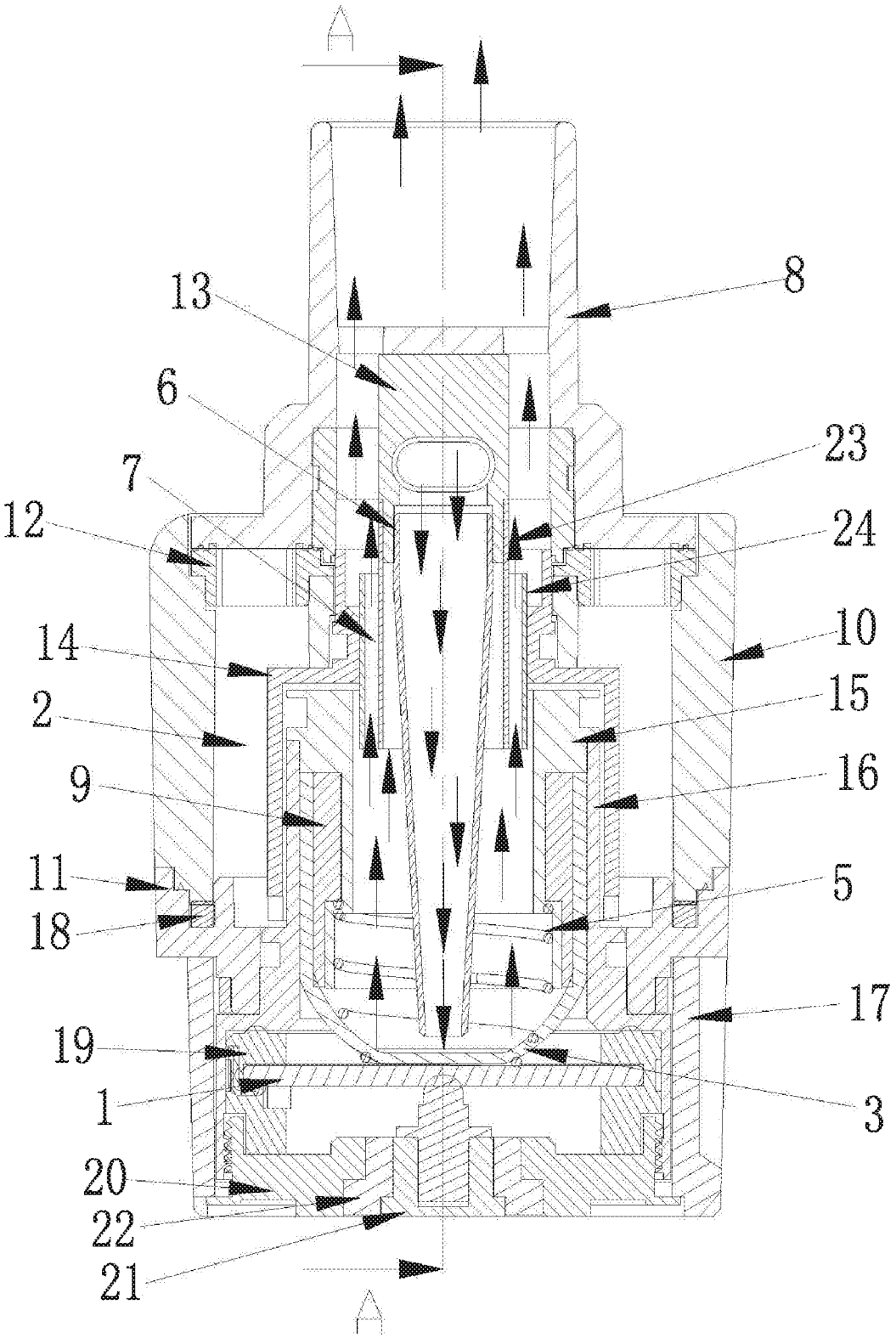
FIG. 1 is a schematic structural diagram of Embodiment 1 of the present invention.

As shown in FIG. 1 to FIG. 5, the first embodiment of an ultrasonic electronic cigarette atomizer comprises an ultrasonic atomization sheet 1, an atomization cotton 3, a liquid chamber 2, an air inlet tube 6, an air outlet channel 7, and a suction nozzle 8, wherein the atomization cotton 3 is communicated with the liquid chamber 2 and is in contact with an atomization surface of the ultrasonic atomization sheet 1, an inlet of the air inlet tube 6 is communicated with the outside, and the air inlet tube 6, an atomization region of the ultrasonic atomization sheet 1, the air outlet channel 7, and the suction nozzle 8 are communicated in sequence; and an outlet of the air inlet tube 6 is opposite to the atomization region of the ultrasonic atomization sheet 1, that is, the spray direction of smoke generated from liquid by high-frequency oscillation of the ultrasonic atomization sheet 1 is opposite to the outlet of the air inlet tube 6, so the inlet air flow overcomes the smoke spray force during smoking and causes the smoke to flow with the air flow.

In this embodiment, the inner diameter of an air inlet end of the air inlet tube 6 is greater than that of an air outlet end of the air inlet tube 6, so that the air flow velocity at the air inlet end of the air inlet tube 6 is smaller than that at the air outlet end of the air inlet tube 6. An optimal solution of this embodiment is that the air inlet tube 6 is a tapered tube, the inner diameter of the air inlet tube 6 is smooth, the flow velocity changes smoothly, and the air flow velocity at the air outlet end of the air inlet tube 6 is stable, thereby ensuring the amount of smoke. The ultrasonic atomization sheet 1 is a piezoelectric ceramic type atomization sheet, and is a solid piezoelectric ceramic type atomization sheet, that is, liquid is atomized on the surface of the ultrasonic atomization sheet 1; and after power on, the piezoelectric ceramic type atomization sheet oscillates at a high frequency to atomize the liquid on the surface to produce smoke, and the frequency of the high-frequency oscillation is 2.2 to 3.2 MHz, preferably 2.4 to 2.6 MHz.

In this embodiment, the ultrasonic electronic cigarette atomizer further comprises an upper cover 10, the top end of the upper cover 10 is connected to the suction nozzle 8, the liquid chamber 2 is provided in the upper cover 10, and the suction nozzle 8 can be rotated on the upper cover 10. The suction nozzle 8 can be rotated to open a liquid injection hole (not shown) of the upper cover 10 to inject liquid into the liquid chamber 2. The bottom end of the upper cover 10 is riveted to the top of a lower cover 11 so that the liquid chamber 2 in the upper cover 10 is better sealed, and at the same time, a bottom cover 17 is connected to the bottom of the lower cover 11; the ultrasonic atomization sheet 1 is fixed through an atomization seat 19 in the bottom cover 17, an inner sleeve 15 and an outer sleeve 16 are disposed in the upper cover 10, a liquid inlet hole (not shown) is provided on the side wall of the outer sleeve 16, and the atomization cotton 3 is sleeved between the inner sleeve 15 and the outer sleeve 16, so the atomization cotton 3 is communicated with the liquid chamber 2 through the liquid inlet hole (not shown), and the bottom end of the atomization cotton 3 abuts against the ultrasonic atomization sheet 1; one end of the air inlet tube 6 is connected to the suction nozzle 8 through an adapter 13, the other end of the air inlet tube 6 is inserted into an inner cavity of the inner sleeve 15 and is in contact with the smoke atomized by the high-frequency oscillation of the ultrasonic atomization sheet 1, so the air flow coming from the air inlet tube 6 can be mixed with the smoke.

In this embodiment, the ultrasonic electronic cigarette atomizer further comprises a first air guide tube 23 and a second air guide tube 24, a cavity 25 is formed between the inner wall of the inner sleeve 15 and the lower section of the air inlet tube 6, the ultrasonic atomization sheet 1 is disposed at the bottom of the cavity 25, and when the ultrasonic atomization sheet 1 oscillates at a high frequency to atomize the liquid to produce smoke, the smoke is sprayed into the cavity 25; the upper section of the first air guide tube 23 is connected to the adapter 13, the upper section of the second air guide tube 24 is connected to a connecting sleeve 14, the lower section of the first air guide tube 23 and the lower section of the second air guide tube 24 both extend into the cavity 25, and the lower section of the first air guide tube 23 and the lower section of the second air guide tube 24 are not in contact with the inner wall of the cavity 25; an air passage 26 is formed between the outer wall of the first air guide tube 23 and the inner wall of the second air guide tube 24, and the cavity 25 is communicated with the air passage 26 to form the air outlet channel 7. When smoking, air enters the cavity 25 from the air inlet tube 6 and mixes with the smoke, forms a smoke air flow which passes through the air passage 26 and then into user's mouth. Therefore, in the process of smoking, large granular liquid beads splashed due to the high-frequency oscillation of the ultrasonic atomization sheet 1 are coagulated or condensed on the inner wall of the cavity 25 by the impact of the inlet air flow, thereby preventing the user from sucking the liquid beads. The direction indicated by the arrows in FIG. 1 is the air flow direction.

Figure 2:
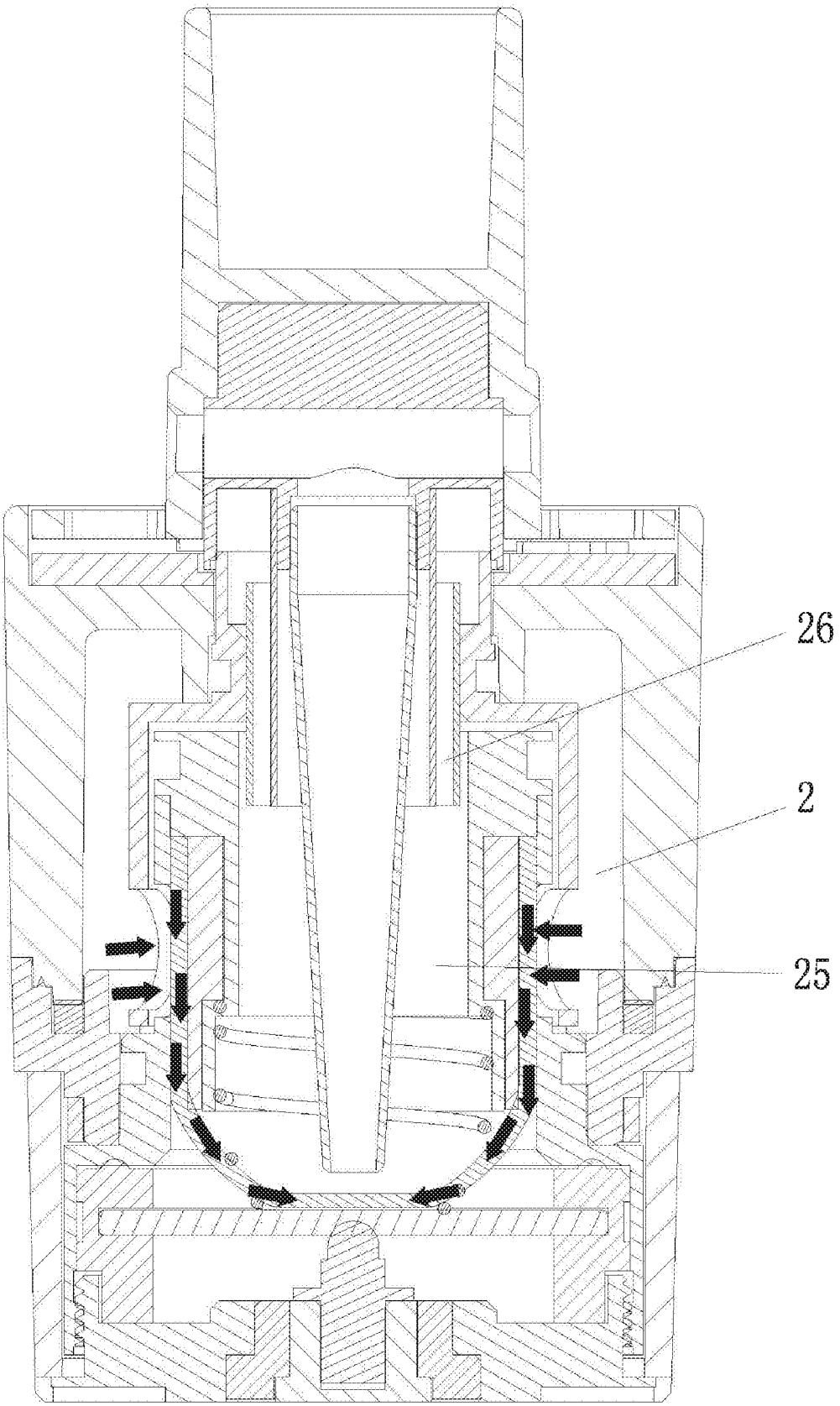
FIG. 2 is a cross-sectional view of A-A in FIG. 1.
Figure 3:
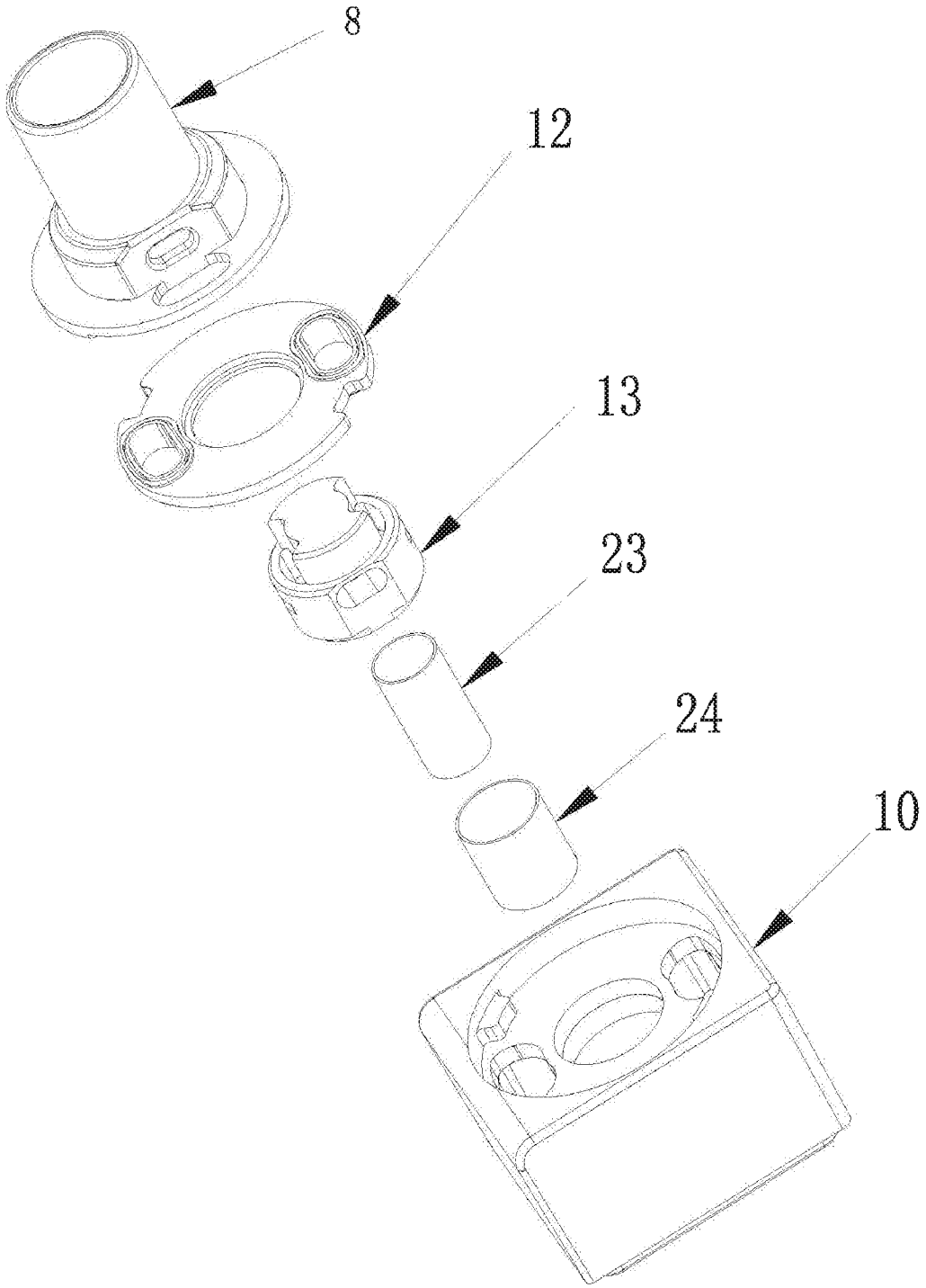
FIG. 3 is an exploded view of the upper part in FIG. 1.
Figure 4:
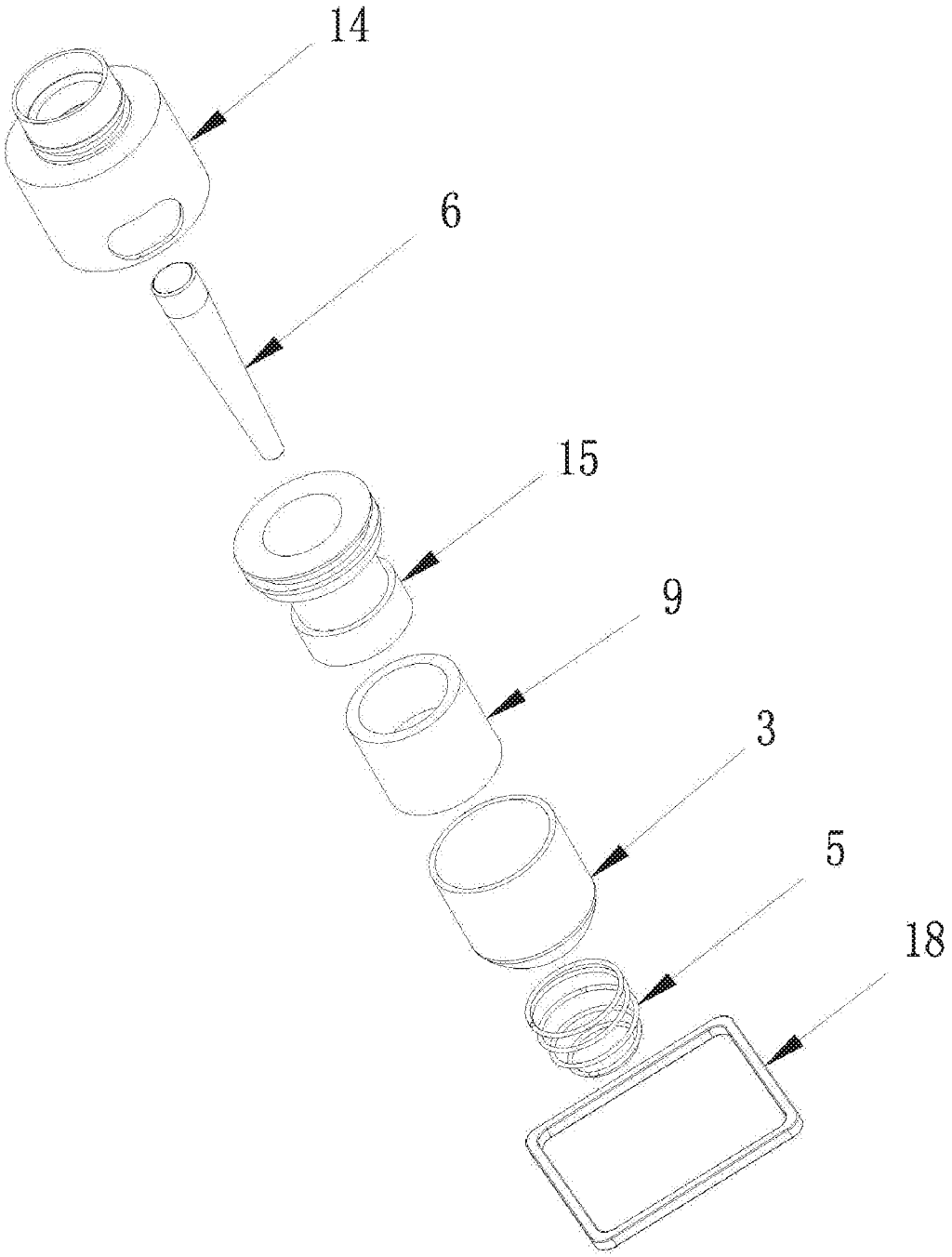
FIG. 4 is an exploded view of the middle part in FIG. 1.
Figure 5:
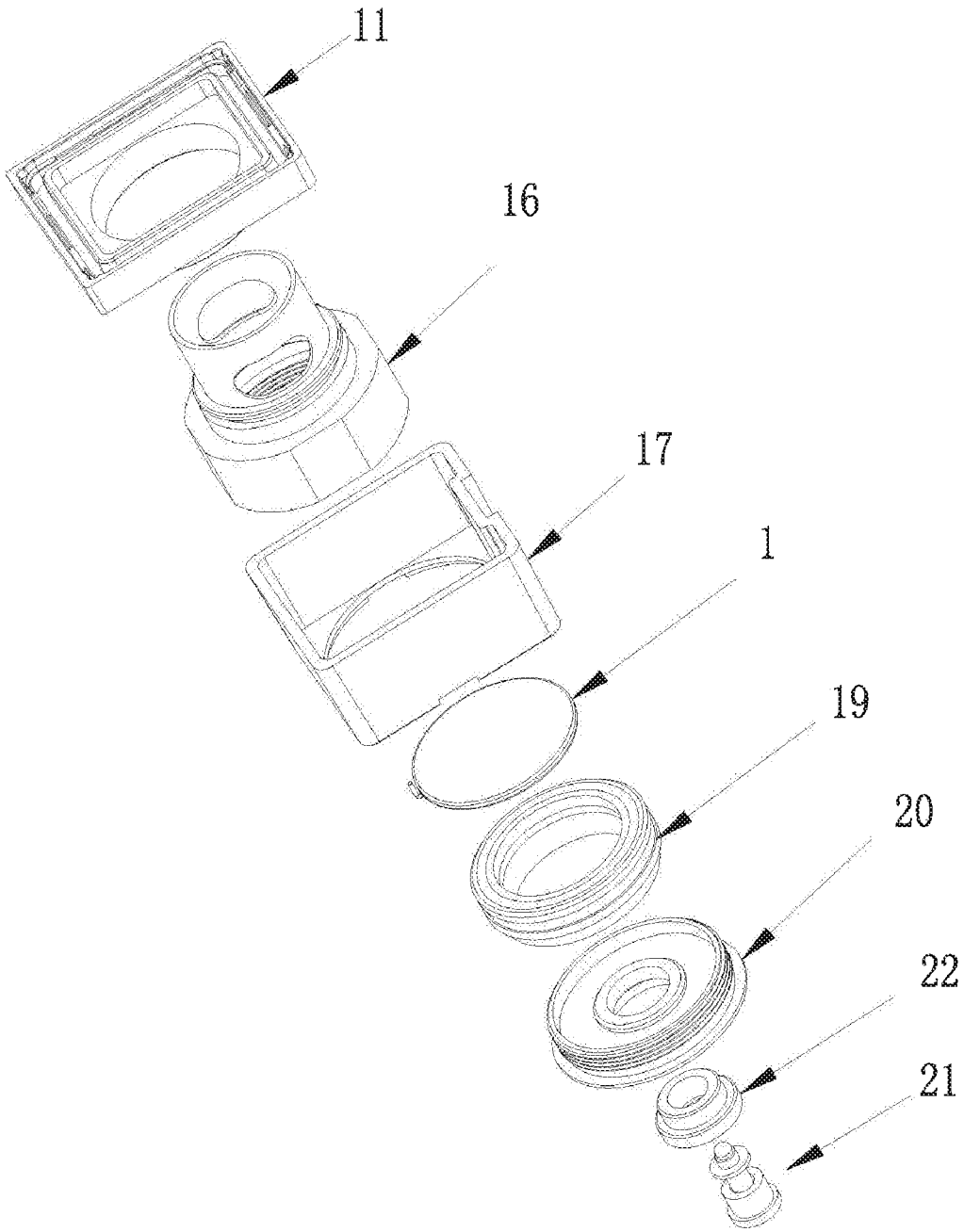
FIG. 5 is an exploded view of the lower part in FIG. 1.

In this embodiment, for the sake of convenient and quick assembly, uniform guidance of liquid to the atomization surface of the ultrasonic atomization sheet 1 and better guide continuity, a preferred solution is that the atomization cotton 3 is cup-shaped, and the bottom of the cup-shaped atomization cotton 3 abuts against the atomization surface of the ultrasonic atomization sheet 1, so the atomization cotton 3 guides the liquid in the liquid chamber 2 to the atomization surface of the ultrasonic atomization sheet 1 to participate in atomization; the top of the cup-shaped atomization cotton 3 is sleeved between the inner sleeve 15 and the outer sleeve 16, such that the atomization cotton 3 is fixed and effectively communicated with the liquid chamber 2; the outer bottom surface of the atomization cotton 3 is in contact with the atomization surface of the ultrasonic atomization sheet 1, and the contact area is smaller than the area of the atomization surface, thereby improving the atomization rate of the ultrasonic atomization sheet 1. As shown in the structure of FIG. 2, the direction indicated by the arrows in FIG. 2 is a liquid passage direction.

In this embodiment, the ultrasonic electronic cigarette atomizer further comprises a cotton compression spring 5, one end of the cotton compression spring 5 abuts against the inner bottom surface of the atomization cotton 3, the other end of the cotton compression spring 5 abuts against the inner sleeve 15, and the cotton compression spring 5 is also cup-shaped. The cotton compression spring 5 is disposed on the inner wall of the cup-shaped atomization cotton 3 and has an efficient close connection with the cup-shaped atomization cotton 3, thereby ensuring enough contact area between the bottom of the cup-shaped atomization cotton 3 and the atomization surface of the ultrasonic atomization sheet 1 and preventing deformation of the cup-shaped atomization cotton 3 during assembly.

In this embodiment, the ultrasonic electronic cigarette atomizer further comprises a liquid guide cotton 9, and the liquid guide cotton 9 is annularly sleeved between the inner sleeve 15 and the atomization cotton 3, so that the atomization cotton 3 stores more liquid to prevent influence on the liquid guide rate caused by wrinkles on the top of the atomization cotton 3 during the assembly of the atomization cotton 3.

In this embodiment, a thread cap 20 for sealing is disposed at the bottom of the bottom cover 17, a lower electrode 21 is disposed in the thread cap 20, and the thread cap 20 is insulated from and connected with the lower electrode 21 by an insulating ring 22.

In this embodiment, a gasket 12 is disposed between the suction nozzle 8 and the upper cover 10, a seal ring 18 is disposed between the lower cover 11 and the upper cover 10, and seal rings for sealing are disposed between all other components connected.

Embodiment 2

Figure 6:
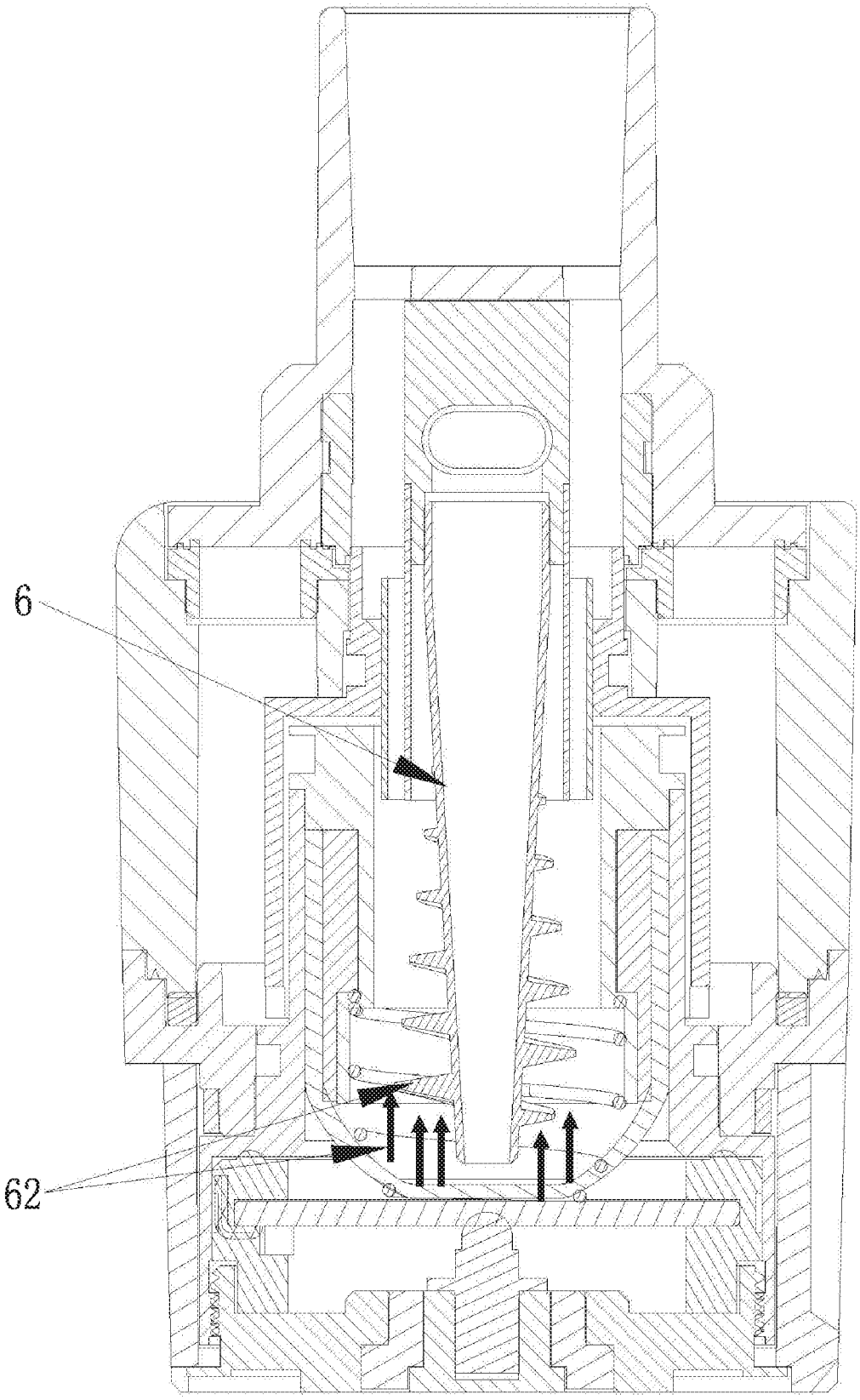
FIG. 6 is a schematic structural diagram of Embodiment 2 of the present invention.

The structure of the second embodiment of the ultrasonic electronic cigarette is shown in FIG. 6. The second embodiment is similar to the first embodiment in structure, except that the bottom of the outer wall of the air inlet tube 6 is provided with a blocking portion 62 for blocking large granular liquid beads in the smoke. In this embodiment, the blocking portion 62 is a spiral baffle disposed at the lower section of the outer wall of the air inlet tube 6.

The blocking portion 62 is located in the direction of spraying smoke generated by atomizing the liquid by the ultrasonic atomization sheet 1, so that the smoke is sprayed to the blocking portion 62, so that large granular liquid beads in the smoke are blocked by the blocking portion 62 and condensed on the surface of the blocking portion 62, and enough large granular liquid beads accumulated are aggregated, flow down along the spiral baffle under the guidance of gravity, and finally drop onto the atomization cotton 3 to participate in atomization again. The blocking portion 62 can also change the direction of air flow, so that the direction of other smoke flowing with the air flow is changed to reduce the large granular liquid beads in the smoke.

The same structure in the second embodiment as the first embodiment is not described herein, which does not affect the understanding and implementation of the present invention by those skilled in the art.

Embodiment 3

Figure 7:
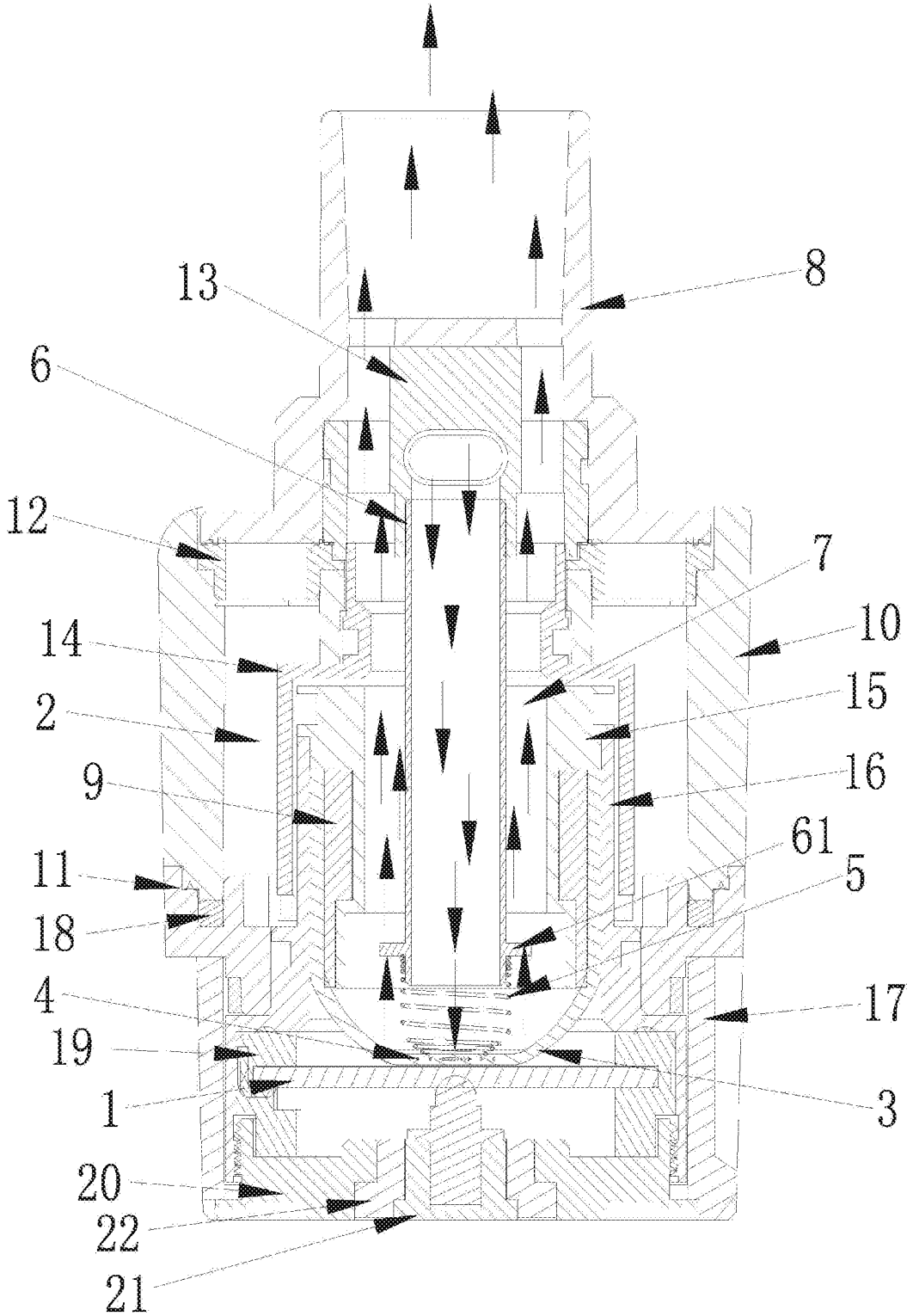
FIG. 7 is a schematic structural diagram of Embodiment 3 of the present invention.
Figure 8:
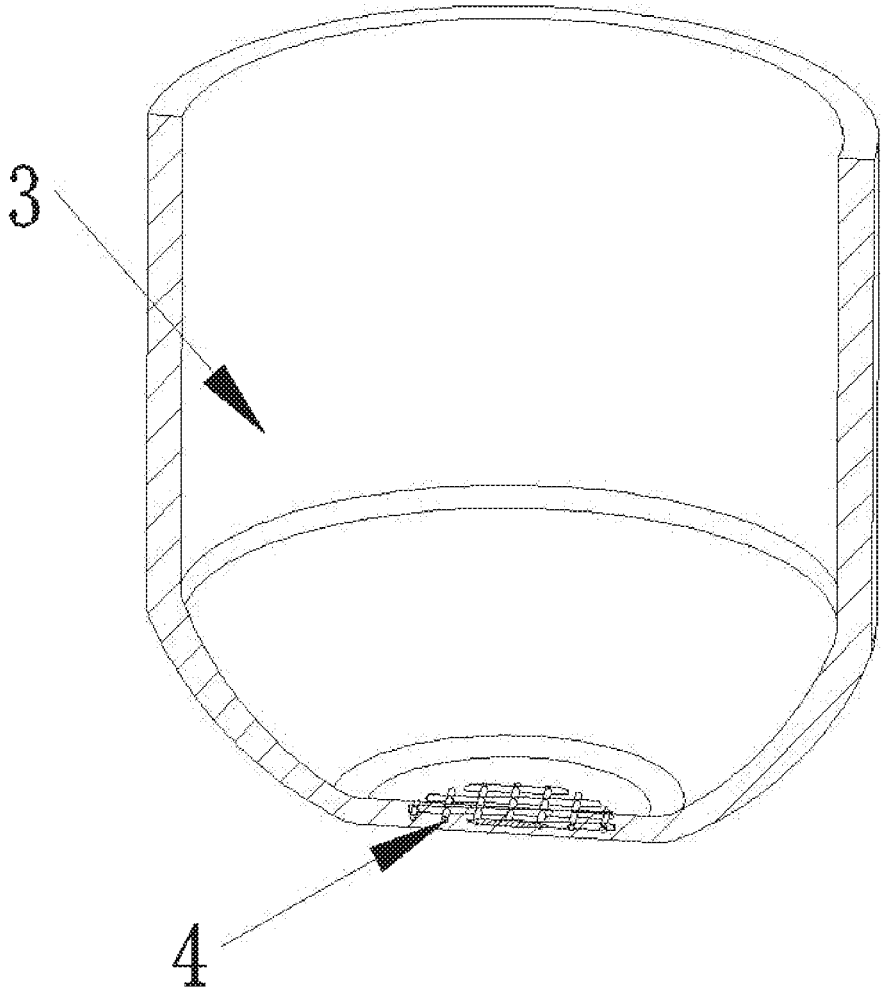
FIG. 8 is a schematic structural diagram of an atomization cotton in FIG. 7.

As shown in FIG. 7 and FIG. 8, in the third structure, the ultrasonic electronic cigarette atomizer comprises an ultrasonic atomization sheet 1, an atomization cotton 3, a liquid chamber 2, an air inlet tube 6, an air outlet channel 7, and a suction nozzle 8, wherein the atomization cotton 3 is communicated with the liquid chamber 2 and is in contact with an atomization surface of the ultrasonic atomization sheet 1, an inlet of the air inlet tube 6 is communicated with the outside, and the air inlet tube 6, an atomization region of the ultrasonic atomization sheet 1, the air outlet channel 7, and the suction nozzle 8 are communicated in sequence; and an outlet of the air inlet tube 6 is opposite to the atomization region of the ultrasonic atomization sheet 1.

In this embodiment, the ultrasonic electronic cigarette atomizer further comprises a cotton compression spring 5, one end of the cotton compression spring 5 abuts against the atomization cotton 3 and causes the atomization cotton 3 to be in close contact with the ultrasonic atomization sheet 1, and the other end of the cotton compression spring 5 abuts against a boss 61 at the end of the air inlet tube 6. When the ultrasonic atomization sheet 1 operates, liquid is atomized into smoke by high-frequency oscillation of the ultrasonic atomization sheet 1, and part of the liquid is splashed to the inner and outer side walls of the outlet of the air inlet tube 6 in this process, so the inner and outer side walls of the air inlet tube 6 and the cotton compression spring 5 are all adhered with liquid beads. When air enters from the air inlet tube 6, the air will blow the liquid beads condensed on the inner and outer side walls of the air inlet tube 6 and the cotton compression spring 5 to the atomization cotton 3 under the guidance of the cotton compression spring 5, and the liquid beads are absorbed by the atomization cotton 3 again, thereby preventing the liquid beads from splashing into the user's mouth to affect the smoke taste. The outlet of the air inlet tube 6 is communicated with the suction nozzle 8 through the cotton compression spring 5 and the air outlet channel 7 in order to bring the smoke into the user's mouth for smoking. The direction indicated by the arrows in FIG. 7 is the air flow direction.

In this embodiment, the atomization cotton 3 is cup-shaped, and the outer wall of the atomization cotton 3 is communicated with the liquid chamber 2.

In this embodiment, the ultrasonic electronic cigarette atomizer further comprises a liquid guide cotton 9, and the inner wall of the atomization cotton 3 is in contact with the liquid guide cotton 9, so that the atomization cotton 3 stores more liquid to prevent influence on the liquid guide rate caused by wrinkles on the top of the atomization cotton 3 when assembling the atomization cotton 3.

In this embodiment, the ultrasonic electronic cigarette atomizer comprises an ultrasonic atomization sheet 1 and an atomization cotton 3 communicated with the liquid chamber 2, the atomization cotton 3 is in contact with one side of the ultrasonic atomization sheet 1, and in the process of high-frequency oscillation of the ultrasonic atomization sheet 1, high-frequency oscillation is also implemented on the bottom of the cup-shaped atomization cotton 3, so the bottom of the cup-shaped atomization cotton 3 is easily broken by oscillation. Therefore, a mat layer 4 is disposed on the bottom of the cup-shaped atomization cotton 3. The mat layer 4 reinforces the bottom of the cup-shaped atomization cotton 3 or isolates the bottom of the cup-shaped atomization cotton 3 from the contact surface of the ultrasonic atomization sheet 1 (a small gap isolation), thereby protecting the bottom of the cup-shaped atomization cotton 3 from being broken by oscillation.

In this embodiment, the ultrasonic atomization sheet 1 is a piezoelectric ceramic type atomization sheet, and is a solid piezoelectric ceramic type atomization sheet, that is, liquid is atomized on the surface of the ultrasonic atomization sheet 1; and after power on, the piezoelectric ceramic type atomization sheet oscillates at a high frequency to atomize the liquid on the surface to produce smoke, and the frequency of the high-frequency oscillation is 2.2 to 3.2 MHz, preferably 2.4 to 2.6 MHz.

In this embodiment, a preferred solution for preventing the bottom of the atomization cotton 3 from being broken by oscillation is that two layers of cotton sheets are disposed on the atomization cotton 3 at a position corresponding to the ultrasonic atomization sheet 1, and the mat layer 4 is sandwiched between the two layers of cotton sheets. The thickness of the cotton sheets is 0.1 to 0.8 mm, preferably 0.1 to 0.4 mm. The thickness of the mat layer 4 is 0.05 to 0.3 mm.

The ultrasonic electronic cigarette atomizer comprises an upper cover 10 and a lower cover 11 connected to each other, the suction nozzle 8 is fixedly connected to the top end of the upper cover 10, and a gasket 12 is disposed between the suction nozzle 8 and the upper cover 10.

The top end of the air inlet tube 6 is fixedly connected to the suction nozzle 8 through an adapter 13.

A connecting sleeve 14 is disposed in the upper cover 10. An inner sleeve 15 and an outer sleeve 16 are disposed in the connecting sleeve 14, the outer sleeve 16 is sleeved on the inner sleeve 15. The side wall of the atomization cotton 3 and the liquid guide cotton 9 are sandwiched between the inner sleeve 15 and the outer sleeve 16.

A bottom cover 17 is connected to the bottom end of the lower cover 11. A seal ring 18 is disposed between the lower cover 11 and the bottom cover 17.

The ultrasonic atomization sheet 1 is fixed through an atomization seat 19 in the bottom cover 17.

A thread cap 20 for sealing is disposed at the bottom of the bottom cover 17.

A lower electrode 21 is disposed in the thread cap 20. The lower electrode 21 is insulated from and connected with the thread cap 20 through an insulating ring 22.

In this embodiment, another preferred solution for preventing the bottom of the atomization cotton 3 from being broken by oscillation is that a single layer of cotton sheet is disposed on the atomization cotton 3 at a position corresponding to the ultrasonic atomization sheet 1, and the mat layer 4 is embedded into the single layer of cotton sheet.

Figure 9:
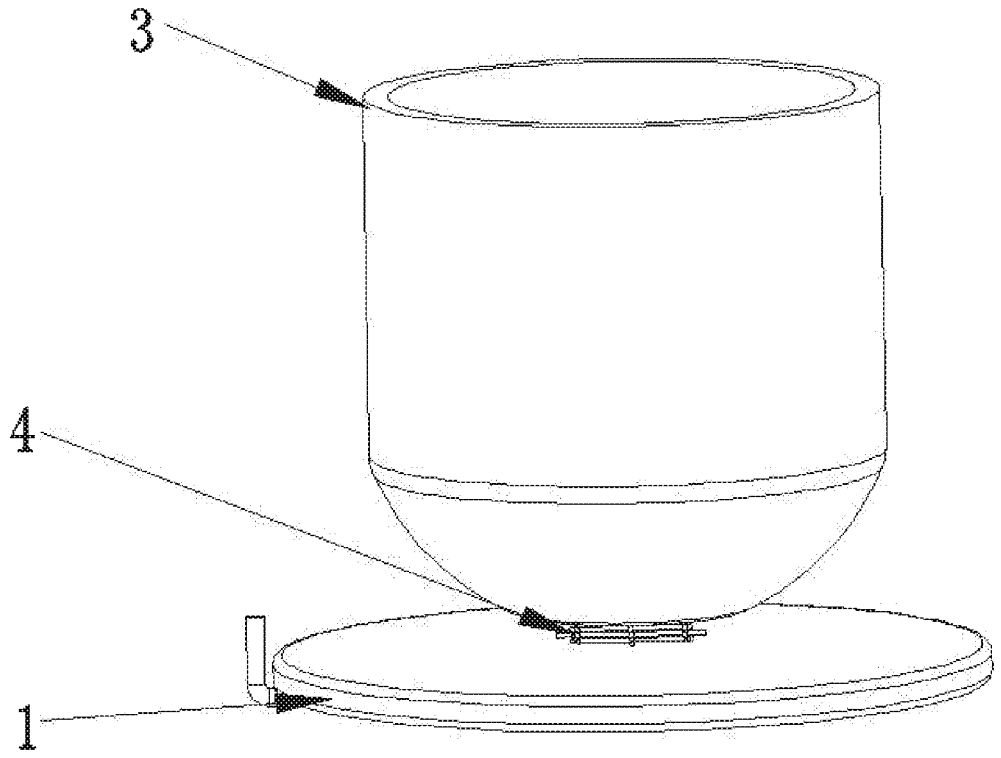
FIG. 9 is a diagram of another connection structure between the atomization cotton and the ultrasonic atomization sheet.

As shown in FIG. 9, in this embodiment, another preferred solution for preventing the bottom of the atomization cotton 3 from being broken by oscillation is that the mat layer 4 is sandwiched between the atomization cotton 3 and the ultrasonic atomization sheet 1. The thickness of the cotton sheet is 0.1 to 0.8 mm, preferably 0.1 to 0.4 mm. The thickness of the mat layer 4 is 0.05 to 0.3 mm.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette atomizer comprising an ultrasonic atomization sheet (1), an atomization cotton (3), a liquid chamber (2), an air inlet tube (6), an air outlet channel (7), and a suction nozzle (8), wherein:

the atomization cotton (3) is communicated with the liquid chamber (2) and is in contact with an atomization surface of the ultrasonic atomization sheet (1);

an inlet of the air inlet tube (6) is communicated with the outside;

the air inlet tube (6), an atomization region of the ultrasonic atomization sheet (1), the air outlet channel (7), and the suction nozzle (8) are communicated in sequence;

an outlet of the air inlet tube (6) is opposite to the atomization region of the ultrasonic atomization sheet (1); and an air inlet end of the air inlet tube (6) having an inner diameter larger than an inner diameter of an air outlet end of the air inlet tube (6);

the ultrasonic cigarette atomizer further comprising:

a cotton compression spring (5), wherein one end of the cotton compression spring (5) abuts against the atomization cotton (3) so that the atomization cotton (3) is in close contact with the ultrasonic atomization sheet (1); and an other end of the cotton compression spring (5) abuts against a boss (61) at an end of the air inlet tube (6); and a mat layer (4) for preventing the atomization cotton (3) from being broken by oscillation.

2. The ultrasonic electronic cigarette atomizer according to claim 1, wherein the air inlet tube (6) is a tapered tube.

3. The ultrasonic electronic cigarette atomizer according to claim 1, further comprising an upper cover (10), wherein:

a top end of the upper cover (10) is connected to the suction nozzle (8);

a bottom end of the upper cover (10) is connected to a lower cover (11);

a bottom cover (17) is connected to a bottom of the lower cover (11);

the ultrasonic atomization sheet (1) is fixed through an atomization seat (19) in the bottom cover (17);

the liquid chamber (2), an inner sleeve (15) and an outer sleeve (16) are disposed in the upper cover (10);

the atomization cotton (3) is sleeved between the inner sleeve (15) and the outer sleeve (16), and the air inlet tube (6) is connected to the suction nozzle (8) through an adapter (13).

4. The ultrasonic electronic cigarette atomizer according to claim 3, further comprising a first air guide tube (23) and a second air guide tube (24), wherein:

a cavity (25) is formed between an inner wall of the inner sleeve (15) and a lower section of the air inlet tube (6);

an upper section of the first air guide tube (23) is connected to the adapter (13);

an upper section of the second air guide tube (24) is connected to a connecting sleeve (14);

a lower section of the first air guide tube (23) and a lower section of the second air guide tube (24) both extend into the cavity (25);

the lower section of the first air guide tube (23) and the lower section of the second air guide tube (24) are not in contact with an inner wall of the cavity (25);

an air passage (26) is formed between an outer wall of the first air guide tube (23) and an inner wall of the second air guide tube (24); and the cavity (25) and the air passage (26) form the air outlet channel (7).

5. The ultrasonic electronic cigarette atomizer according to claim 3, wherein:

the atomization cotton (3) is cup-shaped;

the atomization cotton (3) is sleeved between the inner sleeve (15) and the outer sleeve (16); and an outer bottom surface of the atomization cotton (3) is in contact with the atomization surface of the ultrasonic atomization sheet (1).

6. The ultrasonic electronic cigarette atomizer according to claim 5, wherein the one end of the cotton compression spring (5) abuts against an inner bottom surface of the atomization cotton (3); and the other end of the cotton compression spring (5) abuts against the inner sleeve (15).

7. The ultrasonic electronic cigarette atomizer according to claim 5, further comprising a liquid guide cotton (9), wherein the liquid cotton (9) is sleeved between the inner sleeve (15) and the atomization cotton (3).

8. The ultrasonic electronic cigarette atomizer according to claim 2, wherein:

a thread cap (20) for sealing is disposed at a bottom of the bottom cover (17);

a lower electrode (21) is disposed in the thread cap (20); and the thread cap (20) is insulated from and connected with the lower electrode (21) by an insulating ring (22).

9. The ultrasonic electronic cigarette atomizer according to claim 3, wherein:

a gasket (12) is disposed between the suction nozzle (8) and the upper cover (10); and a seal ring (18) is disposed between the lower cover (11) and the upper cover (10).

10. The ultrasonic electronic cigarette atomizer according to claim 1, wherein a bottom of an outer wall of the air inlet tube (6) is provided with a blocking portion (62) for blocking large granular smoke.

11. The ultrasonic electronic cigarette atomizer according to claim 1, wherein:

two layers of cotton sheets are disposed on the atomization cotton (3) at a position corresponding to the ultrasonic atomization sheet (1), and the mat layer (4) is sandwiched between the two layers of cotton sheets; and alternatively, a single layer of cotton sheet is disposed on the atomization cotton (3) at a position corresponding to the ultrasonic atomization sheet (1), and the mat layer (4) is embedded into the single layer of cotton sheet.

12. The ultrasonic electronic cigarette atomizer according to claim 1, wherein the mat layer (4) is sandwiched between the atomization cotton (3) and the ultrasonic atomization sheet (1).

13. The ultrasonic electronic cigarette atomizer according to claim 11, wherein a thickness of the cotton sheet is 0.1 to 0.8 mm.

14. The ultrasonic electronic cigarette atomizer according to claim 1, wherein a thickness of the mat layer (4) is 0.05 to 0.3 mm.

* * * * *